US009752294B2

(12) United States Patent
Schmalz

(10) Patent No.: US 9,752,294 B2
(45) Date of Patent: Sep. 5, 2017

(54) SINGLE STAGE SNOW THROWER WITH CO-ROTATING IMPELLER AND AUGER

(71) Applicant: Briggs & Stratton Corporation, Wauwatosa, WI (US)

(72) Inventor: Jacob J. Schmalz, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 18 days.

(21) Appl. No.: 14/326,414

(22) Filed: Jul. 8, 2014

(65) Prior Publication Data

US 2015/0007461 A1 Jan. 8, 2015

Related U.S. Application Data

(60) Provisional application No. 61/843,756, filed on Jul. 8, 2013.

(51) Int. Cl.
*E01H 5/09* (2006.01)

(52) U.S. Cl.
CPC ..... *E01H 5/098* (2013.01)

(58) Field of Classification Search
CPC ..... E01H 5/045; E01H 5/098
See application file for complete search history.

(56) References Cited

U.S. PATENT DOCUMENTS 1,638,708 A * 8/1927 Saxon ..... E01H 5/098 37/244
1,820,707 A * 8/1931 Moen ..... E01H 5/098 37/250
2,320,723 A * 6/1943 Gaylord ..... E01H 5/09 37/250
2,508,829 A * 5/1950 Lamy ..... E01H 5/045 37/227
3,303,588 A * 2/1967 Krause ..... E01H 5/045 37/250
3,465,455 A * 9/1969 Kiernan ..... E01H 5/045 165/51
3,583,084 A * 6/1971 Farrell ..... E01H 5/098 37/245
3,805,421 A * 4/1974 Kamlukin ..... E01H 5/045 37/233
4,360,983 A * 11/1982 Krug ..... E01H 5/04 366/312
4,404,763 A * 9/1983 Sakano ..... E01H 5/09 37/248
4,477,988 A * 10/1984 Vohl ..... E01H 5/098 37/250
4,651,452 A * 3/1987 Husso ..... E01H 5/045 37/225
4,951,403 A * 8/1990 Olmr ..... E01H 5/04 37/244
5,398,432 A * 3/1995 Vohl ..... E01H 5/098 37/213

(Continued)

*Primary Examiner* — Jamie L McGowan
(74) *Attorney, Agent, or Firm* — Rathe Lindenbaum LLP

(57) ABSTRACT

A snow thrower head comprises an impeller and an auger disposed within a housing. The impeller is to contact a surface to be cleared by the impeller. The impeller is rotatable within the housing about a first axis while the auger is rotatable within the housing about a second axis above and forward the first axis.

26 Claims, 4 Drawing Sheets

(56) References Cited

U.S. PATENT DOCUMENTS

2013/0291411 A1* 11/2013 Cmich ..... E01H 5/045
37/251
2014/0237864 A1* 8/2014 Gilpatrick ..... E01H 5/045
37/259

* cited by examiner

SINGLE STAGE SNOW THROWER WITH CO-ROTATING IMPELLER AND AUGER

CROSS-REFERENCE TO RELATED PATENT APPLICATIONS

The present application claims priority under 35 USC 119 from U.S. Provisional Application Ser. No. 61/843,756 filed on Jul. 8, 2013 by Jacob J. Schmalz and entitled SINGLE-STAGE SNOW THROWER WITH CO-ROTATING IMPELLER AND AUGER, the full disclosure of which is hereby incorporated by reference.

BACKGROUND

The use of snow throwers (or snowblowers) by both commercial and residential operators is common for those located in snowy winter climates. These snow throwers may be walk-behind units or may be propelled by other machinery (e.g., all-terrain vehicles, tractors, etc.). Typically, snow throwers are divided into two categories: single-stage snow throwers and two-stage snow throwers. Single-stage snow throwers generally incorporate an impeller assembly that is driven by an internal combustion engine (or similar prime mover) to perform the functions of propelling the snow thrower forward, lifting snow from the surface to be cleared, and ejecting the snow out of a discharge chute. Alternatively, a two-stage snow thrower comprises a separate auger assembly and impeller assembly. Both the auger assembly and impeller assembly are driven by an internal combustion engine (or similar prime mover). The auger assembly rotates near the surface to be cleared in order to lift and direct snow and debris to the impeller assembly, which rotates along an axis perpendicular to the axis of rotation of the auger assembly. The impeller assembly then acts to eject snow out of a discharge chute.

In single-stage snow throwers, the impeller assembly is generally formed of a flexible material which contacts the surface to be cleared as it is directed along a path by the user. Due to this direct contact with the surface, single-stage snow throwers typically clear the entire surface of snow quite well. However, because the impeller assembly performs the tasks of propelling the snow thrower, lifting the snow, and ejecting the snow from the discharge chute, there are limitations to the size, shape, and material of the impeller assembly. These limitations reduce the effectiveness of the impeller assembly of a single-stage snow thrower in deep, icy, and/or heavy snow conditions.

On the other hand, two-stage snow throwers are generally more adept at clearing deep and/or heavy snow than their single-stage counterparts. This is because the auger assembly of two-stage snow throwers is typically formed of a rigid material (e.g., metal) that both separates and lifts the snow to be cleared and delivers it to the impeller assembly for ejection from the discharge chute. However, as the auger assembly is formed as a rigid, non-continuous component, the auger assembly is generally positioned within an auger housing so as to be a certain distance above the surface to be cleared. While in some ways it is advantageous for the rigid auger assembly to not contact the surface to be cleared, there is also the potential disadvantage of some snow being left behind and/or compacted as the snow thrower passes. Additionally, two-stage snow throwers are also generally much heavier and more costly than single-stage snow throwers.

Referring to FIG. 1, a conventional assembly for a single-stage snow thrower is shown. An output shaft is connected to an impeller 6, which is supported within a forward portion of the housing by a drive connection. The rear portion of the housing is supported by wheels 7. A handle 8 extends rearwardly of the housing. A control bar 9 is pivotally connected to the upper portion of handle 8 and is capable of being actuated by an operator. The control bar 9 is connected by a cable 10 to the drive connection between the engine's output drive shaft and the impeller 6. During operation of the engine, the operator selectively actuates the control bar 9 to complete the drive connection between the engine and the impeller whereby snow is moved by the impeller 6 and is discharged from the housing through a discharge port provided in the housing above the central portion of impeller 6. An adjustable discharge chute 12 is joined to the port to direct snow thrown by impeller 6. A control rod 15 extends from one of its ends, positioned adjacent to handle 8, to a worm gear (not shown) which is joined to the rod's opposite end. The worm gear is positioned in operative relationship with chute 12 to cause the chute to rotate about a vertical axis in response to actuation of control rod 15 to thereby control the direction of snow discharged from the snow thrower. The distance the snow is thrown is established by the position of a deflector 16 which is pivotally connected about a horizontal axis to the top of chute 12.

Referring to FIG. 2, a schematic side view of a conventional impeller and impeller housing assembly for a single-stage snow thrower is shown. The assembly comprises an impeller 102 coupled to a driven shaft (not shown) which rotates along a path 104 within impeller housing 106 having a mouth 107. Impeller 102 operates to propel collected snow out of a discharge chute (not shown) of the snow thrower via flexible paddles formed of any suitable flexible material, e.g. rubber. Rotational path 104 has a diameter of about 10 inches, while housing 106 is shown as having a height of 12 inches and a depth of 12 inches. Impeller 102 is driven to rotate at a speed of about 1100 RPM. As impeller 102 rotates about path 104 in a direction indicated by arrow 108, the flexible paddles of impeller 102 contact the surface to be cleared of snow to not only lift and propel the snow out of a discharge chute, but also to propel the snow thrower in a forward direction of travel as indicated by arrow 110. However, as discussed above, icy or heavy snow is not readily broken down by impeller 102 alone, which may cause substantial clogging within the impeller housing and/or discharge chute.

DETAILED DESCRIPTION OF EXAMPLES

Figure 3:
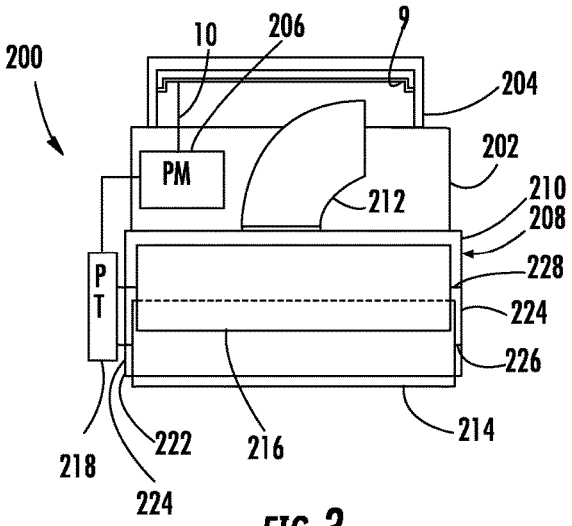
FIG. 3 is a schematic front view of an example single stage snow thrower of the present disclosure.

FIG. 3 is a front view schematically illustrating an example single stage snow thrower 200. As will be described hereafter, snow thrower 200 utilizes an additional co-rotating auger, enhancing the ability of snow thrower 200 to handle icy or heavy snow conditions while effectively cleaning snow directly from the surface being cleared. Snow thrower 200 comprises frame 202, handle 204, prime mover 206 and head 208.

Figure 1:
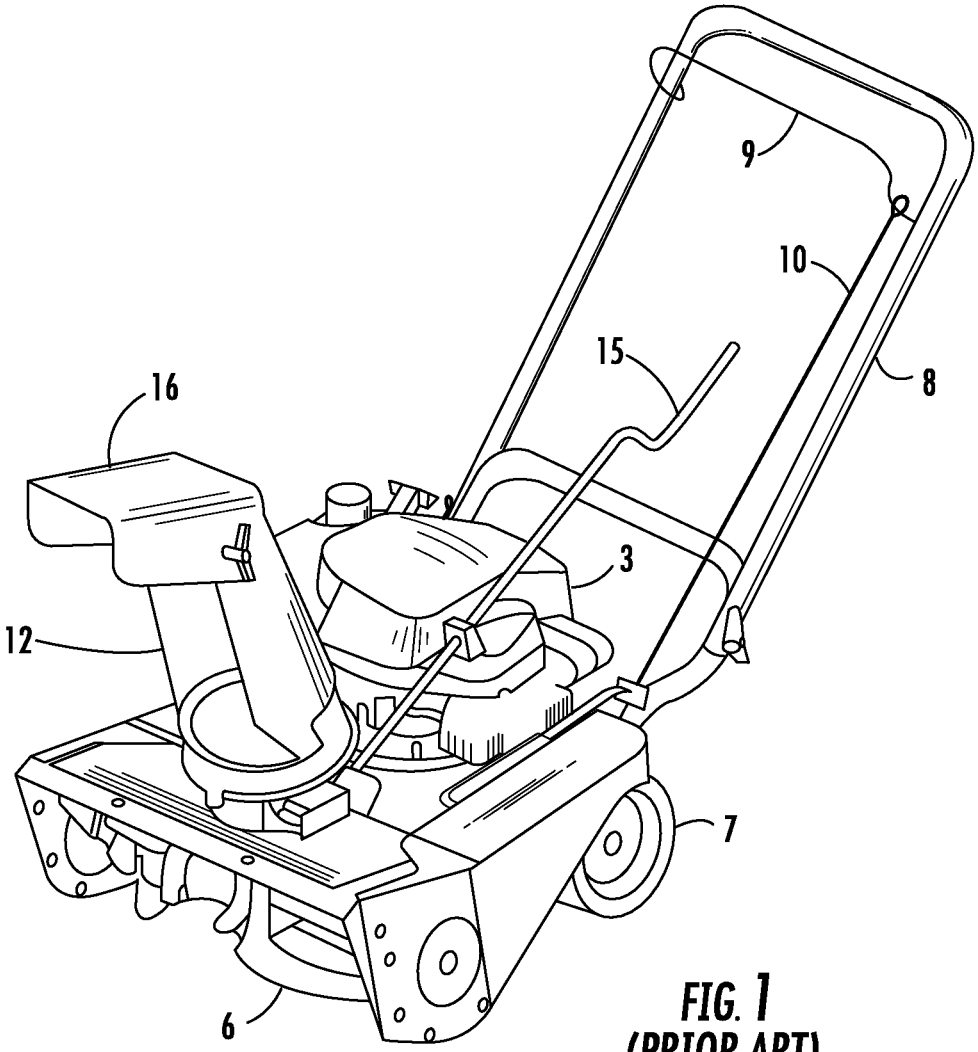
FIG. 1 (PRIOR ART)
FIG. 1 is an isometric view of a conventional single-stage snow thrower.
Figure 2:
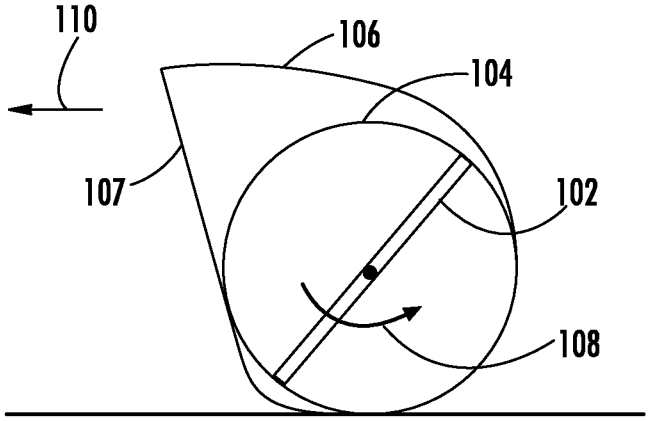
FIG. 2 (PRIOR ART)
FIG. 2 is an schematic side view of a conventional single-stage snow thrower impeller assembly.

Frame 202 comprises a foundational structure for snow thrower 200. Frame 202 supports handle 204, prime mover 206 and head 208. In one implementation, frame 202 rotatably supports wheels, such as wheels 7 shown and described above with respect to FIG. 1. In other implementations, frames 202 may comprise sleds that slide along the underlying terrain. Frame 202 may have a variety different sizes, shapes and configurations.

Handle 204 extends from frame 202 to facilitate manual maneuvering of snow thrower 200. In one implementation, handle 204 is similar to handle 8 shown and described above with respect to FIG. 1. In the example illustrated, handle 204 is additionally associated with control bar 9 and cable 10 described above with respect to FIG. 1. Actuation of control bar 9 selectively engages and disengages either prime mover 206 or the operable coupling of prime mover 206 to head 208. In other implementations, other control mechanisms and arrangements are utilized to allow an operator to selectively engage and disengage head 208.

Prime mover 206 comprises a source of torque for rotatably driving components of head 208. As will be described hereafter, prime mover 206 supplies torque for rotatably driving an auger and an impeller of head 208. In one implementation, prime mover 206 comprises an internal combustion engine operably coupled to head 208 so as to supply torque to components of head 208. In other implementations, prime mover 206 may comprise a source of power or torque, such as an electric motor powered by a battery or an electrical cord plugged into an electrical power source.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. For purposes of this disclosure, the phrase "configured to" denotes an actual state of configuration that fundamentally ties the stated function/use to the physical characteristics of the feature proceeding the phrase "configured to".

Head 208 comprises an assembly mounted to and supported by frame 202. Head 206 is powered by prime mover 206 so to interact with snow and to propel or discharge snow to clear an area. In one implementation head 208 is releasably joined to frame 202 as an assembly or unit such that head 208 is removable as an assembly or unit while remaining intact for repair or replacement or for an upgrade to an existing snow thrower.

Head 208 comprises housing 210, chute 212, impeller 214, auger 216 and powertrain 218. Housing 210 comprises a partial enclosure extending about impeller 214 and auger 216. In one implementation, housing 210 is C-shaped, having a mouth 222 facing in a forward direction, away from handle 204. Housing 210 defines a single uninterrupted interior volume which contains both impeller 214 and auger 216. In the example illustrated, housing 210 includes opposing sidewalls 224 which rotatably support end portions of axles 226, 228 of impeller 214 and auger 216, respectively, about rotational axes which are perpendicular and transverse to the forward direction.

Chute 212 extends upwardly from the interior of housing 210. Chute 212 has an interior for directing and guiding snow propelled by impeller 214. In one implementation, chute 212 is similar to chute 12 described above with respect to FIG. 1. In one implementation, chute 212 additionally comprises deflector 16 and is actuatable to one of various snow directing positions by a control rod 15 (shown in FIG. 1). In other implementations, chute 212 is fixed to direct snow to one side of snow thrower 200 in a sideways or transverse direction.

Impeller 214 comprises one or more paddles, blades or the like rotatably supported by axle 226 for rotation about an axis perpendicular and transverse to the forward direction. In one implementation, impeller 214 comprises one or more pairs of oppositely located paddles extending generally parallel to the rotational axis of axle 226. In another implementation, impeller 214 comprises one or more helical paddles or blades helically extending about the rotational axis of axle 226. In one implementation, impeller 214 is sized and is supported by housing 210 so as to reach into contact and engagement with the underlying terrain, facilitating the wiping, scraping or brushing of snow from the underlying terrain. In another implementation, impeller 214 is supported by housing 210 so as to extend into close proximity to the underlying terrain or just above (less than ½ inch above) the lower scraping edge of housing 210.

In the example illustrated, impeller 214 has blades, paddles or the like that are formed from a flexible material, allowing the blades or paddles to resiliently flex when contacting the underlying terrain. In one implementation, impeller 214 has blades, paddles or the like formed from a material having an elastic modulus or modulus of elasticity (resistance to being deformed elastically, non-permanently) that is less than the elastic modulus of the material forming auger 216. The lower elastic modulus of the blades or paddles of impeller 214 facilitates elastic deformation of such blades or paddles when scraping against the underlying terrain. In one implementation, impeller 214 has blades or paddles that are formed from a rubber or synthetic rubber.

Auger 216 comprises one or more paddles, blades or the like rotatably supported about an axis of axle 228, parallel to the axis of axle 226 and perpendicular to the forward direction in which mouth 222 faces. In one implementation, auger 216 comprises one or more pairs of oppositely located paddles extending generally parallel to the rotational axis of axle 228. In another implementation, auger 216 comprises one or more helical paddles or blades helically extending about the rotational axis of axle 228. Auger 216 is rotatable about the axis of axle 228 forward and above the axis of axle 226. As a result, auger 216 assists in directing deeper or higher snow into interaction with impeller 214. Auger 216 further assists in breaking up ice or other hardened snow to reduce a likelihood of such hardened snow or ice clogging impeller 214 or discharge chute 212.

In the example illustrated, auger 216 is stiffer or more rigid as compared to impeller 214. As a result, auger 216 is better equipped to break up such ice or hardened snow, such as the crust of snow. In one implementation, auger 216 is formed from a material having an elastic modulus greater than the elastic modulus of the material from which the blade(s) or paddle(s) of impeller 214 are formed. In yet another implementation, the blade or paddles of impeller 214 and auger 216 are formed from similar materials, but the thickness and shape of auger 216 are chosen such that auger 216 has a greater bending stiffness as compared to the bending stiffness of the blades or paddles of impeller 214. In one implementation, auger 216 is formed from an inflexible material, such as a metal, such as steel or aluminum.

As further shown by FIG. 3, in the example illustrated, impeller 214 and auger 216 have blades or paddles that rotate in cylindrical or circular paths having outer diameters that intersect or overlap one another. As a result, auger 216 further facilitates the breakup of snow and the guiding of snow to impeller 214 for propulsion through discharge chute 212. At the same time, the amount of additional spacer volume consumed by auger 216 is reduced, allowing the size of housing 210 and the weight of housing 2102 be reduced. In the example illustrated, the rotation of impeller 214 and auger 216 is timed relative to one another such that the blades and/or paddles of impeller 214 and auger 216 interleave with respect to one another during such rotation so as to not interfere with rotation of the other. In other implementations, impeller 214 and auger 216 are alternatively configured such that their blades or paddles and their circular paths do not overlap or intersect. Although impeller 214 and auger 216 are illustrated as rotating in circular paths having substantially the same size outer diameters, as will be described hereafter, in other implementations, the diameters of the circular paths may be different.

Powertrain 218 comprises a mechanism configured to receive torque or power from primary mover 206 and transmit such power to both impeller 214 and auger 216. Powertrain 218 comprise a mechanism to operably link, through mechanical means, rotational speeds and relative positions of impeller 214 and auger 216. Such operable linking of the rotation of impeller 214 and auger 216 results in auger 216 being rotatably driven at a speed that is dependent upon the speed at which prime mover 206 drives impeller 214. In one implementation, such operable linking causes impeller 214 and auger 216 to be driven at the same rotational speed or revolutions per minute. In another implementation, such operable linking causes impeller 214 and auger 216 to be driven at different rotational speeds, wherein impeller 214 is driven at a speed directly proportional to, but less than or greater than, the speed at which the auger 216 is driven.

In one implementation, powertrain 218 is configured, such that impeller 214 and auger 216 are driven in the same direction about their axes. For example, both impeller 214 nor 216 are driven in a counterclockwise direction or a clockwise direction. In one implementation, powertrain 218 is configured such that impeller 214 and auger 216 are both driven in a direction such that a front portion of auger 216 rotates downwardly and rearwardly towards impeller 214 and such that a bottom portion of impeller 214 rotates upwardly and rearwardly to propel snow through chute 212.

In another implementation, power train 218 is configured such that impeller 214 and auger 216 are driven in opposite directions about their axes. For example, while impeller 214 is driven in a clockwise direction, auger 216 is driven in a counterclockwise direction. For example, in one implementation, powertrain 218 is configured such that while the bottom portion of impeller 214 rotates upwardly and rearwardly to propel snow through chute 212, the front portion of auger 216 rotates upwardly and forwardly. In implementations where impeller 214 and auger 216 are rotatably driven in opposite directions, an extent of overlap of the rotational paths of impeller 214 and auger 216 may be larger as compared to when impeller 214 and auger 216 are rotatably driven in the same direction.

In one implementation, powertrain 218 comprises a gear train operably linking rotational speed and relative positioning of impeller 214 and auger 216. In another implementation, powertrain 218 comprises a belt and pulley arrangement or a chain and sprocket arrangement operably linking rotational speed and relative positioning of impeller 214 and auger 216. Although illustrated as being part of head 208, in other implementations, powertrain 218 is carried by frame 202 and is not part of the interchangeable head 208.

Figure 4:
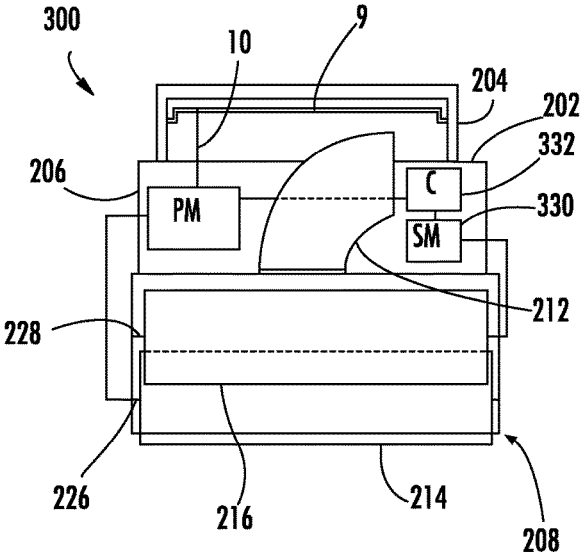
FIG. 4 is a schematic front view of another example single stage snow thrower of the present disclosure.

FIG. 4 schematically illustrates snow thrower 300, another implementation of snow thrower 200. Snow thrower 300 is similar to snow thrower 200 except that snow thrower 300 omits powertrain 218 and additionally comprises secondary mover 330 and controller 332. Those remaining components or elements of snow thrower 300 which correspond to components or elements of snow thrower 200 are numbered similarly or are shown in FIG. 3.

Secondary mover 330 comprises a source of torque or power carried by frame 202 and operably coupled to auger 216. Secondary mover 330 is configured to rotatably drive auger 216 about the axis of axle 228. In the example snow thrower 300 shown in FIG. 4, primary mover 206 is operably coupled to impeller 214 to rotatably drive impeller 214 about the axis of axle 226. In one implementation, secondary mover 330 comprises a different source of power as compared to the source of power for primary mover 206. For example, in one implementation, primary mover 206 comprises an internal combustion engine, wherein secondary mover 330 comprises an electric motor. In yet other implementations, both primary mover 206 and secondary mover 330 comprise similar types of sources of power. For example, in one implementation, both primary mover 206 and secondary mover 330 comprise electric motors or both comprise internal combustion engines.

Controller 332 comprises one or more processing units configured to control the operation of primary mover 206 and secondary mover 330 and/or the transmission of torque or power from primary mover 206 to impeller 214 and from secondary mover 330 to auger 216. Controller 332 outputs control signals operably linking the rotational speeds at which impeller 214 and auger 216 are rotatably driven as well as the relative positions of the blade(s) or paddle(s) of impeller 214 and auger 216. In one implementation, such control signals are transmitted to prime mover 206 and secondary mover 330 which control the output of primary mover 206 and secondary mover 330. In one implementation where both primary mover 206 and secondary mover 330 comprise electric motors, such signals electrically control the output of such motors. In another implementation, such control signals cause one or more actuators, such as solenoids, pneumatic cylinder-piston assemblies or the like to control the output of internal combustion engines or to control/adjust positioning of components of the transmissions between primary mover 206 and impeller 214 and between secondary mover 330 and auger 216.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 332 may be embodied as part of one or more application-specific integrated circuits (ASICs). Unless otherwise specifically noted, the controller is not limited to any specific combination of hardware circuitry and software, nor to any particular source for the instructions executed by the processing unit.

In one implementation, controller 332 outputs control signals such that impeller 214 and auger 216 are driven in the same direction about their axes. For example, both impeller 214 nor 216 are driven in a counterclockwise direction or a clockwise direction. In one implementation, powertrain 218 is configured such that impeller 214 and auger 216 are both driven in a direction such that a front portion of auger 216 rotates downwardly and rearwardly towards impeller 214 and such that a bottom portion of impeller 214 rotates upwardly and rearwardly to propel snow through chute 212.

Figure 5:
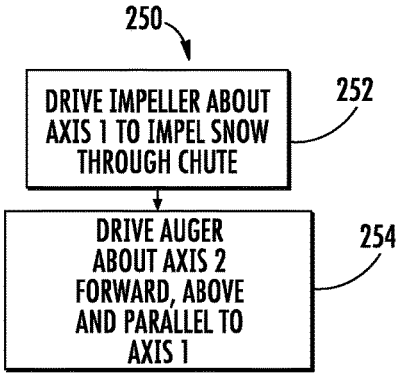
FIG. 5 is a flow diagram of an example method for clearing snow which may be carried out by the snow thrower of FIG. 3 or FIG. 4.

In another implementation, controller 332 is configured to output control signals such that impeller 214 and auger 216 are driven in opposite directions about their axes. For example, while impeller 214 is driven in a clockwise direction, auger 216 is driven in a counterclockwise direction. For example, in one implementation, powertrain 218 is configured such that while the bottom portion of impeller 214 rotates upwardly and rearwardly to propel snow through chute 212, the front portion of auger 216 rotates upwardly and forwardly. In implementations where impeller 214 and auger 216 are rotatably driven in opposite directions, an extent of overlap of the rotational paths of impeller 214 and auger 216 may be larger as compared to when impeller 214 and auger 216 are rotatably driven in the same direction. As a result, the space or volume consumed by impeller 214 and auger 216, as well as the size of housing 210, is reduced FIG. 5 is a flow diagram of an example method 250 that may be carried out by either of snow throwers 200, 300 or by other appropriately configured snow throwers. As indicated by block 252, one or more torque sources, such as primary mover 206, rotatably drive an impeller about a first axis to impel snow through a discharge chute. As indicated by block 254, one or more torque sources, such as primary mover 206 or secondary mover 330 rotatably drive an auger about a second axis that is located forward and above the first axis. The first axis and the second axis extend parallel to one another, perpendicular to a forward direction in which a mouth of the snow thrower faces. In one implementation, the first axis and the second axis are located such that the paths of motion of the auger and the impeller have diameters that overlap or intersect one another.

Figure 6:
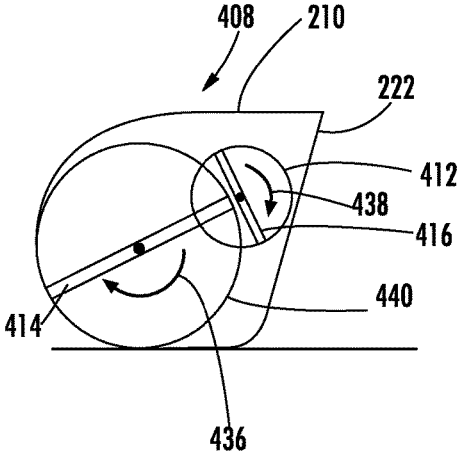
FIG. 6 is a schematic side view of an example head of a single stage snow thrower.

FIG. 6 is a side sectional view of snow thrower head 408, an example implementation of head 208. Snow thrower head 408 may be utilized in either of snow throwers 200 or 300. Snow thrower head 408 is similar to snow thrower head 208 except that snow thrower head 408 comprises impeller 414 and auger 416. In the example illustrated, impeller housing 210 contains an impeller 414 which rotates about an axis perpendicular to the forward direction in which mouth 222 faces. Impeller 414 propels snow through discharge chute 212 shown in FIGS. 3 and 4.

Impeller 414 is at least partially formed of a flexible material (e.g., rubber) to enable impeller 414 to contact the surface to be cleared for both snow removal and propulsion of the snow thrower in a forward direction. As illustrated, impeller 414 is rotatably driven about a path 440 in the direction indicated by arrow 436 at a speed of 1100 RPM and with a rotational diameter of 10 inches. Auger 416 is rotatably driven upon by prime mover 206 or by secondary mover 330 shown in FIGS. 3 and 4, respectively, so as to rotate about a path 442 in the direction indicated by arrow 438. Auger 416 may be constructed of any suitable material (e.g. steel, plastic, etc.).

Auger 416 is placed within impeller housing 210 such that auger 416 co-rotates with impeller 414 and the rotational path 440 of impeller 414 intersects with the rotational path 442 of auger 416. For this co-rotation to occur successfully and without binding of the impeller and auger, auger 416 is sized appropriately (in this case, having a 5 inch diameter rotational path) and is driven at an appropriate speed (i.e., 1100 RPM). With this configuration, impeller 414 and auger 416 may rotate simultaneously to clear and throw snow.

Auger 416 enables the snow thrower to handle deeper snow than would otherwise be possible with impeller 414 alone. Additionally, auger 416 may act to break up hard-packed snow or ice that would otherwise be difficult for impeller 414 to penetrate. In this way, a single-stage snow thrower may incorporate the surface-cleaning benefits of an impeller-driven single-stage snow thrower with the heavy and deep snow removal benefits of an auger-driven dual-stage snow thrower.

Figure 7:
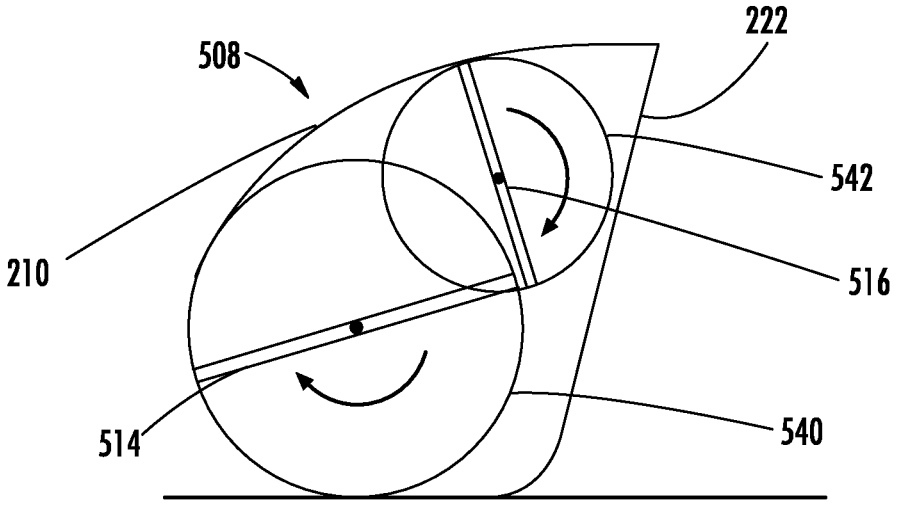
FIG. 7 is a schematic side view of another example head of a single stage snow thrower.

FIG. 7 is a side sectional view illustrating snow thrower head 508, another example implementation of head 208. Snow thrower head 508 may be utilized in either of snow throwers 200 or 300. Snow thrower head 508 is similar to snow thrower head 208 except that snow thrower head 508 comprises impeller 514 and auger 516. In the example illustrated, impeller housing 210 contains impeller 514 which rotates about an axis perpendicular to the forward direction of travel of the snow thrower. Impeller 514 propels snow through discharge chute 212 shown in FIGS. 3 and 4.

As shown by FIG. 7, housing 210 partially surrounds impeller 514 and auger 516. As with the configuration described above with respect to FIG. 6, impeller 514 and auger 516 rotate simultaneously and have intersecting paths of rotation. Impeller 514 rotates at a speed of 1100 RPM and with a path 540 having a diameter of 10 inches. Auger 516 rotates at a speed of 1100 RPM and with a path 542 having a diameter of 7 inches. Auger 516 enables the snow thrower to penetrate deeper and/or more dense snow and works in concert with impeller 514 to efficiently clear and throw snow.

Figure 8:
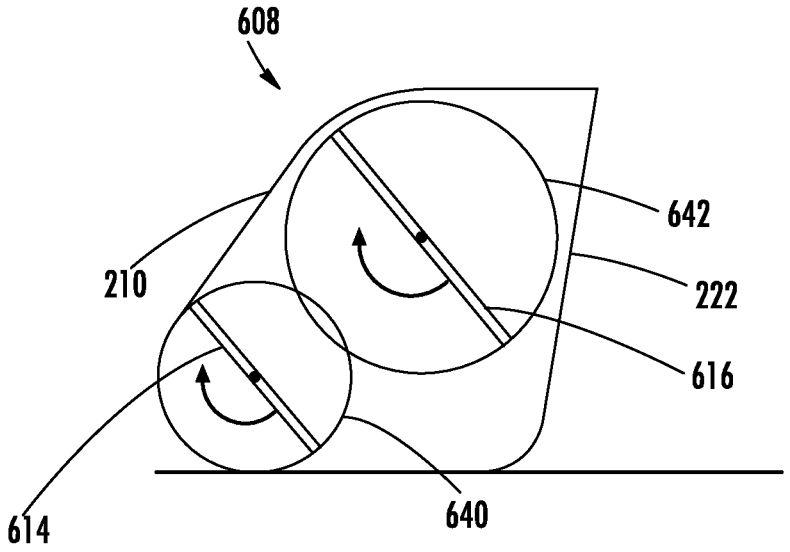
FIG. 8 is a schematic side view of another example head of a single stage snow thrower.

FIG. 8 is a side sectional view illustrating snow thrower head 608, another example implementation of head 208. Snow thrower head 608 may be utilized in either of snow throwers 200 or 300. Snow thrower head 608 is similar to snow thrower head 208 except that snow thrower head 508 comprises impeller 614 and auger 616. In the example illustrated, impeller housing 210 contains impeller 614 which rotates about an axis perpendicular to the forward direction of travel of the snow thrower. Impeller 614 propels snow through discharge chute 212 shown in FIGS. 3 and 4.

Housing 210 is configured to partially surround and support impeller 614 that rotates along a path 640 at high rate of speed (e.g., 1650 RPM). Auger 616 rotates simultaneously along a path 642. However, unlike the embodiments shown in FIGS. 6 and 7 above, impeller 614 has a rotational path diameter 640 smaller than that of auger 616. For example, path 640 may have a 7 inch diameter, while path 642 may have a 10 inch diameter. Also, auger 614 is rotatably driven at a slower speed (e.g., 825 RPM) than impeller 616, effectively increasing the torque that the auger can apply to break up condensed snow and ice. In this way, impeller 614 may act to clear snow from the surface and propel snow from the snow thrower, while auger 616 may act to pull in and break up deeper and more condensed snow within impeller housing 210.

Figure 9:
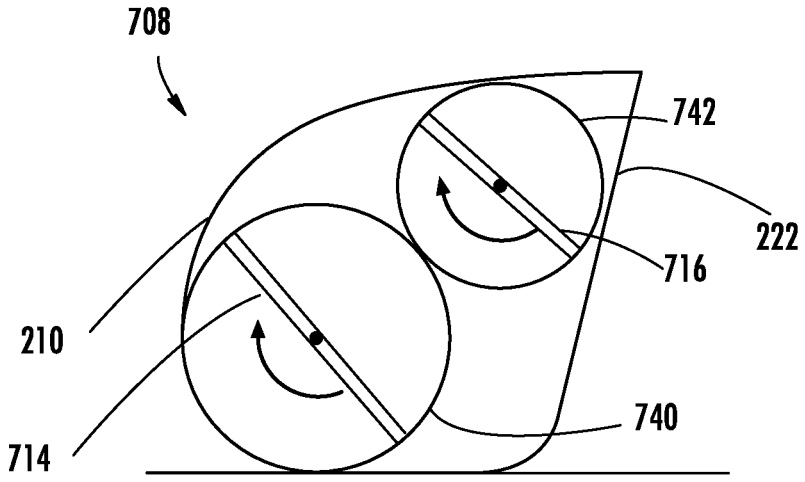
FIG. 9 is a schematic side view of another example head of a single stage snow thrower.

FIG. 9 is a side sectional view illustrating snow thrower head 708, another example implementation of head 208. Snow thrower head 708 may be utilized in either of snow throwers 200 or 300. Snow thrower head 708 is similar to snow thrower head 208 except that snow thrower head 708 comprises impeller 714 and auger 716. In the example illustrated, impeller housing 210 contains impeller 714 which rotates about an axis perpendicular to the forward direction of travel of the snow thrower. Impeller 714 propels snow through discharge chute 212 shown in FIGS. 3 and 4.

Housing 210 is configured to partially surround and support impeller 714 that rotates along a path 740 at a high rate of speed (e.g., 1420 RPM). Auger 716 rotates simultaneously with impeller 714 along a path 742 with higher torque and a slower rate of speed (e.g., 355 RPM). In this embodiment, path 740 and path 742 do not intersect, but the operation of impeller 714 and auger 716 is still complimentary in that impeller 714 acts to clear the surface and light snow while auger 716 acts to break up condensed snow and break through deep snow to subsequently feed that snow to impeller 714 for propulsion out of housing 210.

Although each of snow thrower heads 408, 508, 608 and 708 are illustrated as having their impellers and augers rotating in the same direction about their axes, in other implementations, the direction of rotation of the augers of each of such snow thrower heads 408, 508, 608 and 708 are reversed so as to rotate in opposite directions with respect to the impellers. Rotation of the augers in the same direction as the impellers facilitates movement of snow towards the impellers. Rotation of the augers in an opposite direction as the impellers facilitates a greater overlap of the auger with the impeller to reduce space consumption and the size of housing 210.

While the preferred embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A single-stage snow thrower comprising:

a prime mover;

a discharge chute;

a housing defining a volume, the volume comprising a portion contained underneath the discharge chute, the housing further defining a forward opening in front of and transversely extending across the portion of the volume and through which snow may pass into the portion of the volume;

an impeller disposed within the portion of the volume of the housing underneath the discharge chute, the impeller operably coupled to the prime mover and rotatable within the housing about a first axis;

an auger disposed within the housing in front of the discharge chute and rotatable within the housing about a second axis parallel to, above and forward the first axis.

2. The snow thrower of claim 1, wherein the impeller has a first rotational path and wherein the auger has a second rotational path differently sized than the first rotational path.

3. The snow thrower of claim 2, wherein the first rotational path is larger than the second rotational path.

4. The snow thrower of claim 2, wherein the first rotational path is smaller than the second rotational path.

5. The snow thrower of claim 1, wherein impeller has a first rotational path and wherein the auger has the second rotational path, wherein the first rotational path and the second rotational path intersect.

6. The snow thrower of claim 1, wherein the prime mover is operably coupled to the auger so as to rotatably drive the impeller and the auger.

7. The snow thrower of claim 6 further comprising a power train operably linking the auger and the impeller such that the prime mover rotatably drives the auger at a first speed dependent upon a second speed at which the prime mover drives the impeller.

8. The snow thrower of claim 7, wherein the second rotational speed is less than the first rotational speed.

9. The snow thrower of claim 8, wherein the impeller has a first rotational path and wherein the auger has a second rotational path larger than the first rotational path.

10. The snow thrower of claim 1 further comprising a secondary mover operably coupled to the auger to rotatably drive the auger, wherein the primary mover comprises a first internal combustion engine or a first electric motor and wherein the secondary mover comprises a second internal combustion engine or a second electric motor.

11. The snow thrower of claim 10, wherein the prime mover and the secondary mover are operably linked such that the secondary mover rotatably drives the auger at a first speed based upon a second speed at which the primary mover rotatably drives the impeller.

12. The snow thrower of claim 11, wherein the impeller has a first rotational path and wherein the auger has a second rotational path larger than the first rotational path and wherein the first speed is less than the second speed.

13. The snow thrower of claim 10 comprising a controller operably linking operation of the prime mover and the secondary mover.

14. The snow thrower of claim 1, wherein the impeller comprises a flexible blade.

15. The snow thrower of claim 14, wherein the flexible blade comprises rubber.

16. The snow thrower of claim 14, wherein the auger comprises a first blade formed from a first material having a first elastic modulus and wherein the impeller comprises a second blade formed from a second material having a second elastic modulus less than the first elastic modulus.

17. The snow thrower of claim 1, wherein the housing comprises opposite side walls rotatably supporting a first axle of the impeller and a second axle of the auger.

18. The snow thrower of claim 1 comprising rotatable snow engaging and driving members consisting of the impeller and the auger.

19. The snow thrower of claim 1, wherein the impeller comprises a paddle supported and rotatably driven to lift snow off of the underlying terrain and to impel the snow directly into the discharge chute.

20. The snow thrower of claim 1, wherein the prime mover is operably coupled to the impeller to drive the impeller in a same direction about the first axis as the auger is driven about the second axis.

21. The snow thrower of claim 1, wherein the auger comprises oppositely located paddles extending parallel to the second axis.

22. A snow thrower header comprising:

a housing;

a discharge chute extending from the housing;

an impeller underneath the discharge chute and disposed within the housing so as to contact an underlying terrain to be cleared by the impeller, the impeller rotatable within the housing about a first axis to lift snow from the underlying terrain and impel the snow directly into the discharge chute;

an auger disposed within the housing and rotatable within the housing about a second axis above and forward the first axis.

23. The snow thrower header of claim 22, wherein the housing defines a volume having a portion directly below the discharge chute and a forward opening in front of the portion of the volume through which snow may pass into the portion of the volume and wherein the auger is disposed within the housing in front of the discharge chute.

24. The snow thrower of claim 22, wherein impeller has a first rotational path and wherein the auger has the second rotational path, wherein the first rotational path and the second rotational path intersect.

25. A method comprising:

rotatably driving an impeller underneath a discharge chute about a first axis and in direct contact with terrain underlying snow to be lifted from the underlying terrain and to directly impel the snow into and through the discharge chute; and rotatably driving an auger about a second axis parallel to, above and forward the first axis to move the snow towards the impeller.

26. A single-stage snow thrower comprising:

a prime mover;

a housing;

a discharge chute;

an impeller disposed within the housing underneath the discharge chute, the impeller operably coupled to the prime mover and rotatable within the housing about a first axis;

an auger disposed within the housing and rotatable within the housing about a second axis parallel to, above and forward the first axis, wherein the housing has opposing side walls, the housing defining a single uninterrupted interior volume containing both the impeller and the auger, wherein the auger overlies a continuous uninterrupted empty volume bounded by a bottom of the auger, a front of the housing and a front of the impeller.

* * * * *